US005338414A

United States Patent [19]

Ullman et al.

[11] Patent Number: 5,338,414

[45] Date of Patent: Aug. 16, 1994

[54] ELECTROLYTIC CELL, ELECTROLYZER AND A METHOD OF PERFORMING ELECTROLYSIS

[75] Inventors: Anders Ullman, Ljungaverk; Johan Wanngard, Sundsvall; Mikael Tenfalt; Olov Dalenius, both of Ljungaverk, all of Sweden

[73] Assignee: Permascand AB, Ljungaverk, Sweden

[21] Appl. No.: 39,087

[22] PCT Filed: Sep. 25, 1991

[86] PCT No.: PCT/SE91/00645

§ 371 Date: Jun. 8, 1993

§ 102(e) Date: Jun. 8, 1993

[87] PCT Pub. No.: WO92/07115

PCT Pub. Date: Apr. 30, 1992

[30] Foreign Application Priority Data

Oct. 10, 1990 [SE] Sweden ..... 9003226

[51] Int. Cl.[5] ..... C25B 1/02; C25B 1/26; C25B 9/00

[52] U.S. Cl. ..... 204/95; 204/129; 204/267; 204/269; 204/279

[58] Field of Search ..... 204/267, 270, 279, 268–269, 204/95, 129

[56] References Cited

U.S. PATENT DOCUMENTS 4,060,475 11/1977 Fournier et al. ..... 204/269 X
4,075,077 2/1978 Hodges ..... 204/269
4,194,953 3/1980 Hatherly ..... 204/269 X
4,194,961 3/1980 Williams ..... 204/269 X

FOREIGN PATENT DOCUMENTS 3117483 11/1982 Fed. Rep. of Germany .
2283245 3/1976 France .
110922 5/1967 Norway .
8801715-7 10/1989 Sweden .

OTHER PUBLICATIONS

Ullman's Encyclopedia of Industrial Chemistry, 5th Edition, 1986, vol. 6, pp. 501–511.

*Primary Examiner*—Donald R. Valentine
*Attorney, Agent, or Firm*—Burns, Doane, Swecker & Mathis

[57] ABSTRACT

The present invention relates to an electrolytic cell (1) comprising an anodic end wall (6) and a cathodic end wall (5) facing each other and supporting alternately arranged plate-shaped anodes (8) and cathodes (10) extending substantially perpendicularly to said end walls. At least some of the anodes (8) and/or cathodes (10) cooperate with the opposite end wall (5,6) via electrically insulating spacer members (4), thus enabling compressive forces to be transmitted between the cell end walls (5,6). The invention also relates to an electrolyser comprising two or more cells (1) according to the invention. Further, the invention relates to a method of performing electrolyses.

14 Claims, 3 Drawing Sheets

Figure 1A:
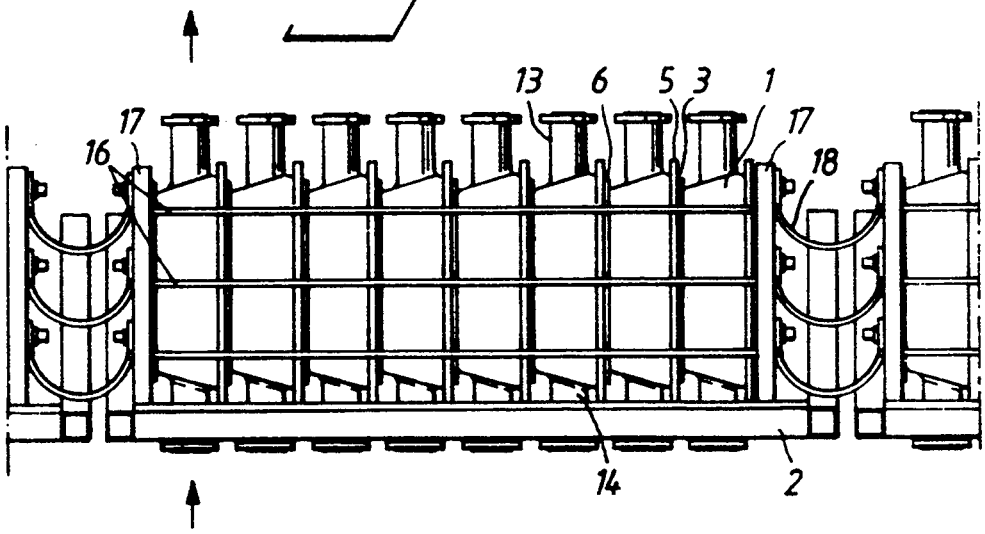

Fig. 2
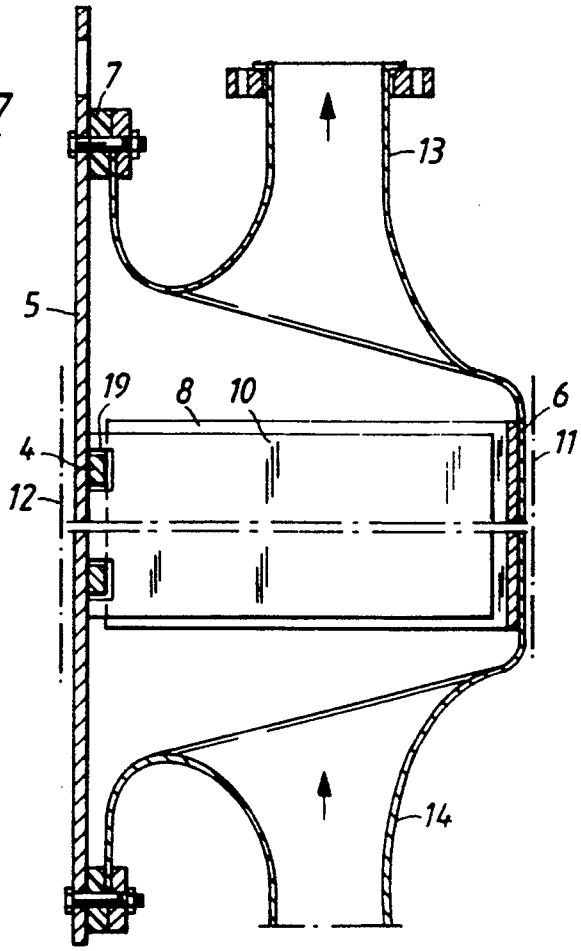
Fig. 3a
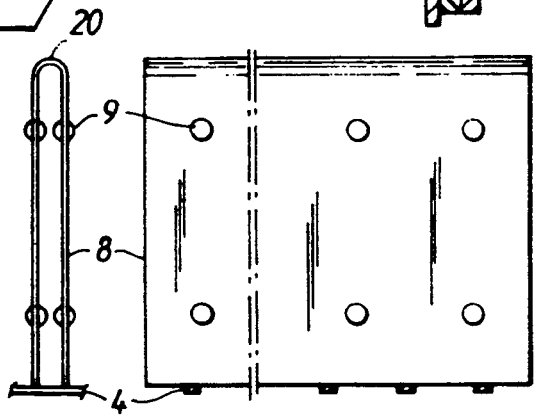
Fig. 3b
Fig. 4
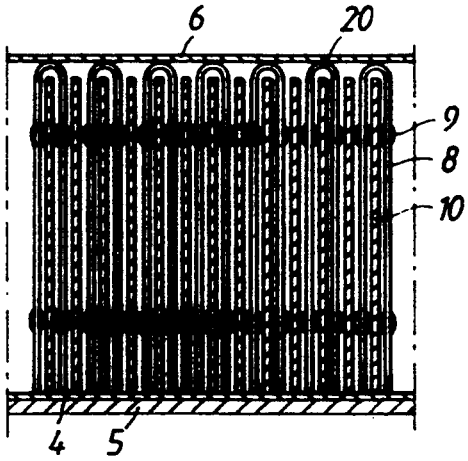

ELECTROLYTIC CELL, ELECTROLYZER AND A METHOD OF PERFORMING ELECTROLYSIS

The present invention relates to an electrolytic cell comprising an anodic end wall and a cathodic end wall facing each other and supporting alternately arranged plate-shaped anodes and cathodes extending substantially perpendicularly to said end walls. At least some of the anodes and/or cathodes cooperate with the opposite end wall via electrically insulating spacer members, thus enabling compressive forces to be transmitted between the cell end walls. The invention also relates to an electrolyser comprising two or more cells according to the invention. Further, the invention relates to a method of performing electrolyses.

Sodium chlorate is extensively used in the cellulose industry for producing the bleaching agent chlorine dioxide. Chlorate can also be used for producing rocket fuel and weedkillers, and for enriching uranium.

The production of sodium chlorate is described in detail in the available literature, see e.g. "Ullmann's Encyclopedia of Industrial Chemistry", 5th Ed., 1986, Vol. 6, pp 501–511, 521–525. Industrial production is performed by electrolysing sodium chloride in electrolytic cells, e.g. comprising alternately arranged plate-shaped anodes and cathodes. An electrolyser generally consists of a plurality of electrolytic cells electrically connected in series. In the cells, hypochlorite is formed which is conducted together with the electrolyte to reactors where it is converted into chlorate. A part of the product is withdrawn as a solution or as crystals, while the remaining electrolyte is recycled to the cells together with freshly-supplied sodium chloride. The electrolyte is highly corrosive, which places high demands on the construction materials. The cathodically protected parts may consist of iron or steel, while the other parts in general must be made of titanium or fluoroplastics, which is most expensive. The anodes usually are made of titanium and coated with a catalytically active layer based on platinum-group metals, while the cathodes most often consist of iron or steel. For economical operation, the electrical energy supplied must be used as efficiently as possible.

The cell voltage U in a chlorate cell with iron cathodes and activated metal anodes can be expressed in volts by the formula $$U=2.35+k.i+f_{korr}$$

where k is the cell constant (ohm.m$^2$.10$^{-3}$) which is a measure of the cell resistance, i is the current density (kA/m$^2$) while $f_{korr}$ is a temperature-dependent term which is zero at the temperature where the decomposition voltage is determined and which decreases by about $10^{-3}$ V/° C.

For optimal production in a cell, the current density should be as high as possible. At given values for k and $f_{korr}$, this can only be achieved by increasing the cell voltage, excessively high values resulting in secondary reactions causing current losses. To permit a high current density, the cell constant, i.e. the electric resistance in and between the cells, should be as low as possible. Known chlorate electrolysers generally operate with a k-value of 0.18 to 0.25. For optimal function, it is also necessary to have as uniform a current distribution as possible between the electrodes in each cell. Meeting the above-mentioned requirements normally involve substantial costs, especially with respect to the anodic parts made of titanium which is a considerably poorer electric conductor than iron.

Another problem is the formation of deposits on the cathodes, increasing the cell voltage. Chlorate plants are therefore regularly shut down with electrolyte remaining in the cells which results in a decrease of the pH and dissolving of the deposits, but also in severe corrosion of the cathodes which therefore normally have to be changed after a few years operation.

From e.g. FR, A, 2,283,245 it is known to provide contact between series-connected electrolytic cells by arranging them in a filter-press-like frame where they are pressed against each other, this making it easier to disassemble the electrolyser. In known electrolysers of the filter press type, the anodes and the cathodes consist of plates extended parallel no the end walls and arranged with insulating spacer members between then. With such an arrangement, it is difficult, at low costs to achieve a satisfactory current distribution between the electrodes and design cells with a sufficiently large electrode surface.

NO patent 110922 disclose a cell comprising electrically insulation means between the anodes and the cell casing. The above problems are not dealt with.

In another prior art electrolyser, as described e.g. in the above-mentioned Ullmann publication, the cells are connected in series and, through their end walls, electrically connected to contact plates. The electrodes in the cells consist of plates extended perpendicularly to the end walls. To achieve adequate contact between the cells and a satisfactory current distribution between the electrodes, the cell end walls must be explosion-bonded to the contact plates, which is costly and also makes it more difficult to disassemble the electrolyser for repairs and maintenance. Since explosion-bonding is expensive, the end wall surfaces are made small and the electrodes long, creating a long flow path for the electric current. Thus, in order to reduce the resistance and the current losses, the electrodes, in particular the anodes, must be made relatively thick, which means a large consumption of the comparatively expensive metal titanium. Explosion bonding also requires the end walls to be comparatively thick, thus further increasing material consumption.

The present invention aims at solving the problem of providing an electrolyser being easy to disassemble and at the same time having low electric resistance and being inexpensive to manufacture. This has been possible to achieve by means of an electrolyser comprising electrolytical cells being in electrical contact with each other and subjected to compressive forces substantially perpendicular to the contact surfaces. It has also been found possible to provide an electrolytical cell suitable for such an electrolyser.

The invention thus concerns an electrolytic cell according to claim 1. More specifically, the cell comprises an anodic end wall and a cathodic end wall facing each other and supporting alternately arranged plate-shaped anodes and cathodes extending substantially perpendicularly to said end walls. At least some of the anodes and/or cathodes cooperate with the opposite end wall via electrically insulating spacer members, thus enabling compressive forces to be transmitted between the cell end walls.

The cell according to the invention suitably comprise a casing in which the anodes and cathodes are arranged, the casing being closed except for an inlet and outlet for electrolyte. In order to provide for good electric contact between two cells positioned adjacent to each other, it is suitable that at least the outer surface of each one of the cell end walls comprises a substantially plane portion substantially perpendicular to the electrode plates, which plane portion preferably extends over substantially the entire area of the end walls supporting the electrode plates. Preferably, the anodic parts of the cells are made of a valve-metal or alloy, most preferably titanium or a titanium alloy. According to a preferred embodiment, a cell is made up of a preferably deep-drawn anodic part in the form of a trough which, for example by means of a screw assembly, is detachably joined with a cathodic end wall having cathode plates attached thereto, electrically insulating means, for example a gasket, being placed between the anodic trough and the cathodic end wall. In this case, the trough and the cathodic end wall thus together form the cell casing. Suitably, the cell is designed for a high electrolyte flow rate, preferably from about 1 about 2 m/s. To this end, the electrodes and the other liquid-contacted surfaces are suitably smooth by suitable processing or trimming. Such a high flow rate permits a small electrode spacing and also means that the size of gas bubbles in the electrolyte is reduced. Thus, the cells can operate with a high current density. It is preferred that the anode plates are coated with a catalytic coating comprising oxides preferably of spinel structure, containing platinum-group metals and titanium, alternatively with a mixture of platinum-group metals in metallic form. Examples of usable platinum-group metals in both cases are Pt, Ru, Rh and It. The cathodic parts are preferably made of steel.

The highest demand for contact pressure in the cell end walls is at the points in the immediate vicinity of the electrodes made up of the material having the lowest electric conductivity. If the anodes are of titanium and the cathodes of iron or steel, it is therefore preferred that the anodes cooperate with the opposite cathodic cell end wall via electrically insulating spacer means, this making the contact pressure the greatest at the anodes. Particularly, it is preferred that substantially all the anodes in the cell cooperate in this manner with the opposite cell end wall. It is then also preferred that the cathodes do not cooperate with the opposite anodic cell end wall.

To avoid breakage of the electrodes and to facilitate maintaining their correct positions in the cells, it is preferred that electrically insulating spacer means are provided between anodes and cathodes. Preferably, the anodes are double electrodes in the form of U-profile plates which at their closed ends are in electric contact with and fixed to the anodic cell end wall. The anodes can be manufactured by bending plates of a suitable size. Usable dimensions for each plate in the double electrode may be a thickness from about 0.75 to about 1.25 mm, a length from about 100 to about 250 mm, and a height from about 700 to 1200 mm. The same dimensions can be used even if the anodes are single plates fixed to the end wall. The cathodes preferably consist of plates fixed to the cathodic cell end wall in electric contact therewith. Preferably, the cathode plates have substantially the same length and height as the anode plates, while a suitable thickness of the cathode plates may range from about 2 to about 3 mm. The spacing between anodes and cathodes should be small to minimise cell resistance, for instance from about 1 to about 3 mm, preferably from about 1.5 to about 2.5 mm. It is preferred that the height-to-length ratio of the electrode plates from about 2:1 to about 15:1, especially from about 3:1 to about 10:1. The electrodes can be fixed to the respective end wall in any suitable manner, preferably by welding, e.g. resistance welding or laser welding. A preferred thickness of the cell end walls is from about 3 to about 10 mm for the cathodic one and from about 1.5 to about 3 mm for the anodic one.

The electrically insulating distance members for transmitting compressive forces should be made of corrosion-resistant and mechanically stable material, for instance ceramic materials, such as silicon nitride, silicon carbide or borosilicate glass, alternatively a fluoroplastic reinforced with fibres of any of the above-mentioned materials. They may be fixed, e.g. by gluing with corrosion-resistant glue, both to the electrode plates and to the cell end wall with which the electrodes cooperate. The insulating spacer means between anodes and cathodes may consist of button-shaped bodies, preferably in a number of from 2 to 50 in each spacing, glued or otherwise fixed to the anodes and/or the cathodes and made of any of the above-mentioned materials.

Suitably, one or both of the two end walls of the cell are provided on its outer surfaces with a layer having high electric conductivity, which layer may cover substantially the entire plane surface or just a portion of said surface, for example in the form of dots or strings. At least end walls made of titanium, titanium alloys or other valve metals are preferably provided with such layers.

According to one embodiment, preferably both the end walls of the cell are provided with layers having high electric conductivity, which layer is rough and preferably made of a nickel, copper, silver or alloys thereof. The layers should preferably cover substantially the entire the outer plane surfaces of the end walls. The layers can be applied by thermal surface alloying, e.g. by laser or TIG (Tungsten Inert Gas) so that they are metallically joined to the substrate. This embodiment is particularly advantageous if the cells are to be included in a electrolyser of a filter-press type using intermediate conducting elements to create the electrical contact between the cells. If that will be the case, the same type of layer can be applied to the end walls of the filter-press-like frame.

According to another embodiment, the outer surface of any end wall made of a valve metal is provided with a layer wettable by soft-solder, the joint to the surface of the end wall also having sufficient strength to be suitable for supporting a soldered joint and maintaining good electric contact to the end wall. Accordingly, it should be possible to join the end wall of the cell to another cell by soft soldering, thus providing excellent electric contact between the cells. Soft solder refers to solder melting at temperatures below about 350° C., preferably below about 300° C., most preferably below about 250° C. The wettable layer should preferably be applied by a low temperature method. A preferred method involves ultra sonic soldering using solder comprising tin, lead and rare earth metals, for example solder available under the trade mark CERA-SOLZER ®, thus providing a layer wettable by soft solder and joined to the surface with sufficient strength. Another method involves applying a foil of copper or silver by vacuum soldering, preferably using a solder comprising silver and flux. A wettable layer with suitable properties is thus obtainable by any of the above methods, but also other methods of providing such a layer may come into consideration. The wettable layer may cover parts of or substantially the entire plane outer surfaces of one or both the end walls. For economic reasons, it is preferred that only the end wall made of titanium or a titanium alloy is provided with such a layer, and most preferably that only part of the surface, preferably from about 60 to about 90%, are covered by the wettable layer. Most preferably the wettable layer is applied in the form of strings or dots substantially uniformly distributed over the plane surfaces.

The invention also concerns an electrolyser comprising two or more electrolytic cells as described above. Preferably, the electrolyser comprise at least one row of series-or parallel-connected electrolytic cells, the cells preferably being electrically connected to each other via their end walls. It is also conceivable to use two or more parallel rows of cells. Preferably, each row includes 5 to 15 cells. A production plant generally includes a plurality of preferably series-connected electrolysers. Unless otherwise stated, the terms "series connection" and "parallel connection" relate to electrical connection.

In order to secure good electrical connections, the electrolyser is preferably provided with conducting means between the cells. Further, the cells are preferably arranged so as to be subjected to compressive forces substantially perpendicularly to the cell end walls, i.e. substantially parallel to the electrode plates. The conducting means between the cells may consist of soft solder or intermediate conducting elements held at their positions solely by compressive forces created by pressing the cells in a row together.

Compressive forces transmitted through longitudinally extended electrodes as described above, means that a better distributed contact pressure can be achieved, thus reducing the electric losses, as compared with prior art devices of the filter press type. Since the inventive arrangement is inexpensive, the end wall surface can be given a large size. This permits the use of short electrodes with small electric losses, which in turn means that the electrodes can be thin and that considerable quantities of expensive material can be saved. Thanks to the good contact between the cells, the end walls can also be made thin, without entailing any problems in respect of the current distribution between the electrodes. Since the cells are detachably joined together, an electrolyser according to the invention can also be disassembled very easily for subsequent repairs or change of electrodes. For instance, newly-developed electrodes with improved characteristics can be mounted in an existing plant without necessitating any modification of the cell. Further, the inventive design makes it possible to use cells of highly reduced volume, which facilitates, inter alia, dumping of electrolyte upon shutdown of the plant, for instance, for maintenance. This is especially advantageous in small-size production plants which are not always run continuously. Thanks to the ease of shutdown and the readily exchangeable electrodes, it is also possible to use highly contaminated raw materials. The invention also allows a very compact, space-saving design. It has been found that as low values as 0.125–0.15 $Ohm.m^2.10^{-3}$ for the cell constant k can be achieved, which means that the electrolyser can be operated without any difficulty at a current densify exceeding 3.5 $kA/m^2$.

In most cases, it is preferred that the separate cells in each row are connected to each other in series. Then, only the first and the last cell in each row need be directly connected to an external electric power source, which then may be connected to the end walls of a frame, it being preferred that there is provided between the end walls of the frame and the outer cells conducting means of the same type as between the cells. If two or more rows of cells are used, it is preferred that they are connected in parallel. The separate cells in each row may also be parallel-connected in that an external source of electric power is connected to each conducting means between the cells. In this case, every other conducting means is disposed between two anodic cell end walls, while every other is disposed between two cathodic cell end walls. This latter embodiment is advantageous in plants having a considerable existing rectifying capacity.

Each cell has an inlet and an outlet for electrolyte, preferably in the form of a lower and an upper riser pipe, respectively, arranged in the lower and the upper cell wall, respectively, and connected to suitable equipment for supplying raw materials and optionally recycled electrolyte, and further processing of the electrolyte, respectively. To achieve the required pumping effect for circulating electrolyte through the cell, it is preferred that the upper riser pipe has a height of above about 4 m, which also brings about a relatively high hydrostatic pressure in the cell. Particularly, a height from 4 to 10 m is preferred. The inlets and outlets are preferably connected to the anodic part of the cell and are suitably made of resistant, electrically insulating material, such as glass, fluoroplastics or the like. Advantageously, the cell is provided with two leakage current extinction means integrated in the two riser pipes and connected to common ground in such a manner that the current through the individual leakage current extinction means can be read individually. These may, for instance, be made of titanium alloyed with an electrochemically active oxide of spinel structure, such as $RuO_2/TiO_2$. To obtain low flow resistance, the electrode plates suitably have an extent parallel to the direction of flow which in most cases means a vertical extent. Preferably, each cell includes about 40 to about 80 anode plates and an equal number of cathode plates.

According to one embodiment, the electrolyser comprise one or more rows of cells are arranged in a frame comprising means for producing high compressive stresses in the longitudinal direction of the cell row, preferably of a size of about 400 to about 800 $kN/m^2$. Suitably, intermediate conducting elements are arranged between the cells and held at their positions by the compressive forces. The means for producing compressive stresses may include traction rods extending between the two end walls of the frame. A frame according to this embodiment can thus function according to the same principles as a filter press frame.

The intermediate conducting elements for providing good electric contact between the cells suitably have a certain elasticity for a uniform distribution of the contact pressure across the end wall surfaces of the cells. Preferably, they are sufficiently large to cover the surfaces of the cell end walls. They can also be made sufficiently large to cover two or more parallel rows of cells. A preferred thickness is from about 0.5 to about 5 mm. To achieve good contact, it is preferred that the intermediate conducting element has on each side a large number of recurrent raised portions. This can be achieved by making the surfaces of a plate rough or "spiny" by working them with a design cylinder, preferably in at least two directions at right angles to each other. A surface having recurrent raised portions can also be obtained by making the intermediate conducting elements of expanded metal, preferably of a mesh providing from 10 to 20 point contacts per $cm^2$. Another variant is to join tubes together, which may be filled with an elastomeric material, in a step-like arrangement, preferably such that the spacing between the tubes corresponds to the spacing between the electrodes transmitting the contact pressure in the cells. A preferred construction material is copper, optionally alloyed with beryllium, and optionally having a protective conducting surface coating containing nickel and silver.

According to another embodiment, the cells in each row are connected to each other by soft soldering, i.e. soldering at a temperature below about 350° C., preferably below about 250° C., most preferably below about 200° C., the solder however not no be meltable at temperatures below about 100° C., preferably not below about 120° C. In order to perform the soft soldering, the surfaces to be soldered, i.e. the outer surfaces of the cell end walls, should be wettable by soft solder. Thus, at least any surface made of a valve metal or alloy should preferably comprise a layer wettable by soft solder and joined to the surface with sufficient strength to be able to support a soldered joint. The wettable surfaces are then provided with conventional soft solder, for example solder essentially based on tin and lead or tin and silver, and the surfaces are assembled and joined by heating, preferably to a temperature from about 150° to about 225° C., for example by induction heating. The joint may easily be broken by heating to about 250° or 350° C. In order to improve the strength of the joint, also a resin may be used, which resin in cured state should be breakable by heating. Before assembling the surfaces to be joined, suitably from about 5 to about 50%, preferably from about 10 to about 30% of one of the surfaces is coated with resin, for example in the form of strings or dots, preferably substantially uniformly distributed over the surface. If the layer wettable by soft solder does not cover the entire plane surface, the resin is preferably applied on the portions not covered by the above layer. The cured resin should preferably be breakable at a temperature from about 250° to about 350° C. Most preferably the resin used is heat curable at a temperature from about 150° to about 200° C., thus enabling the curing and soldering to be performed in one operation. For example, one-component heat curable epoxy resin may be used. In order to provide good electrical contact all over the surface, the cells are preferably subjected to compressive forces when soldering. The cells are preferably arranged in a frame supporting the cathodic end walls and optionally also pressing the cells in a row together.

The invention also relates to a method of performing electrolysis, the method involving use of a electrolytic cell or an electrolyser according to the invention. The method thus involves subjecting an aqueous solution, optionally containing one or more salts, to electrolysis by flowing the solution through the cells in an electrolyser according to the above description. Particularly, the method concerns electrolysing an aqueous solution containing sodium chloride. The invention particularly concerns a method for producing alkali metal chlorate and involves electrolysing an aqueous solution containing sodium chlorate. The electrolysis is performed by causing an aqueous solution containing sodium chloride to flow via the lower riser pipe through the cells, so as to form, inter alia, hypochlorite and hydrogen gas. The hydrogen gas contributes to press the electrolyte out through the upper riser pipe, leading to one or more reactors where chlorate is formed. The gases, mostly hydrogen gas, formed in the cells are separated and withdrawn from the solution at the end of the upper riser pipe. A preferred cell voltage is from about 2.5 to about 3.5 V, while the current density preferably exceeds about 3 $kA/m^2$ and most preferably is from about 3.5 to about 4.5 $kA/m^2$. A preferred flow rate for the electrolyte through the cells is from about 1 to about 2 m/s, this giving a highly satisfactory mass transport. A preferred working temperature is from about 80° to about 95° C. The hydrostatic pressure in the cells preferably exceeds about 1.4 bar, and most preferably is from about 1.4 to about 2 bar. The relatively high pressure increases the contact pressure between the cells and reduces the size of the gas bubbles existing in the electrolyte and, hence, the electric resistance.

In addition to the production of chlorate, an electrolyser according to the invention may, for instance, be used for producing hypochlorite or for electrolysis of water.

To illustrate the invention in more detail, an embodiment especially suited for producing sodium chlorate will now be described with reference to the accompanying drawings. The invention is however not restricted thereto, but many other embodiments are conceivable within the scope of the accompanying claims.

Figure 1B:
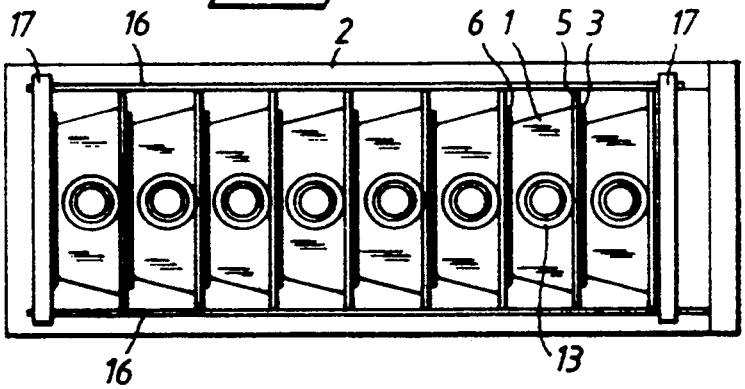

FIGS. 1*a* and 1*b* show an electrolyser according to the invention from the side and from above, respectively.

FIG. 2 is a sectional view showing a cell from the side, of which the central portion is however broken away.

FIGS. 3*a* and 3*b* show an anode from above and from the side, respectively.

FIG. 4 is a sectional view showing a portion of a cell from above.

FIGS. 5*a*, 5*b*, 6*a* and 6*b* show different types of intermediate conducting elements.

Figure 7:
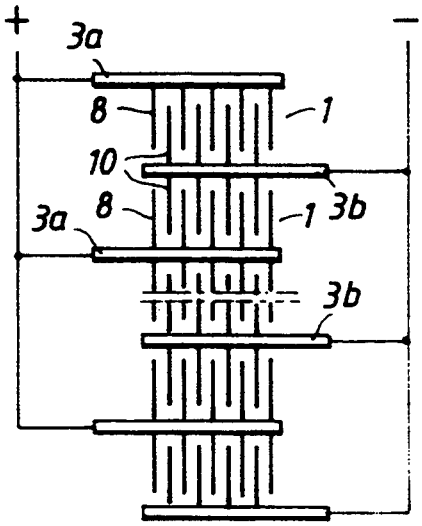

FIG. 7 schematically shows an alternative coupling arrangement with parallel-connected cells.

In FIGS. 1*a* and 1*b*, the electrolyser according to the shown embodiment consists of eight electrically series-connected cells 1 in a filter-press-like frame 2. The plane end wails 5, 6 of the cells 1 are in electric contact with each other and with the end walls 17 of the frame 2 via conducting means 3 having high electric conductivity, for example intermediate conducting elements or soft solder. The filter-press-like frame 2 may have traction rods 16 so tensioned as to bring about a compressive force through the cells 1 between the end walls 17 of the frame. This provides for mechanical strength and good electric contact both between the cells 1 and between the outermost cells and the frame end walls 17. Each cell also has an inlet in the form of a lower riser pipe 14 and an outlet in the form of an upper riser pipe 13. FIG. 1*a* shows how the electrolyser is connected in series with two others by electric lines 18.

From FIG. 2 appears that a cell 1 comprise a casing is made up of a substantially plane cathodic end wall 5 of steel, and an anodic part of deep-drawn titanium with a substantially plane end wall 6. These parts are galvanically separated by an insulating gasket 7. The outer sides of the end walls 5, 6 are coated with layers 11, 12 of a material having high electric conductivity, optionally wettable by soft solder and joined to the end wall with sufficient strength to be able to support a soldered joint. Anodes 8 and cathodes 10 are arranged parallel and alternately in the form of vertically standing plates extending between the two end walls 5, 6. The plate-shaped anodes 8 are welded to the inner side of the anodic end wall 6 and cooperate with the cathodic end wall 5 through electrically insulating spacer members 4 in the form of horizontally extending strips fixed to the inner side of the end wall 5. The plate-shaped cathodes 10 are welded to the inner side of the cathodic end wall 5 and have recesses 19 for the insulating strips 4. From FIGS. 3*a*, 3*b* and 4 appears that the anodes 8 are double electrodes in the form of plates having a U-shaped profile, which are fixed at their closed ends 20 to the anodic end wall 6. Further, button-shaped electrically insulating spacer means 9 are fixed on the anode plates, such that the anodes 8 and the cathodes 10 are kept apart and maintained in position despite the fact that considerable compressive stresses are transmitted between the cell end walls 5, 6 via the anodes 8.

Figure 5A:
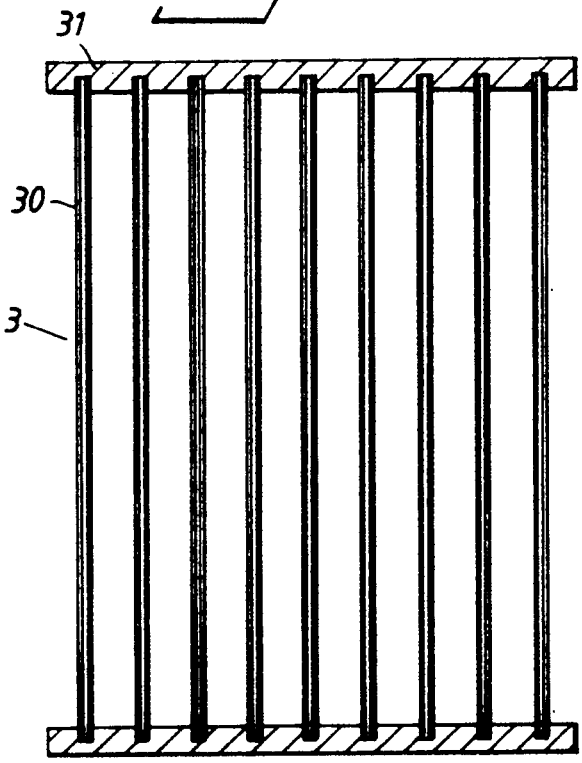
Figure 5B:
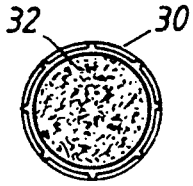

FIG. 5*a* is a top plan view showing an intermediate conducting element 3 useful for providing electric contact between the cells. The intermediate conducting element is made up of copper tubes 30 having rough surfaces and fixed to two rods 31, e.g. of brass, with a spacing between the tubes 30 corresponding to the spacing between the fixing points of the anodes 8 in the cells 1. In an electrolyser, the intermediate conducting elements 3 are arranged with the tubes 30 opposite the fixing points of the anodes, such that the contact pressure is at a maximum where it is best required. FIG. 5*b* shows how the copper tubes 30 are filled with elastomeric material 32.

Figure 6A:
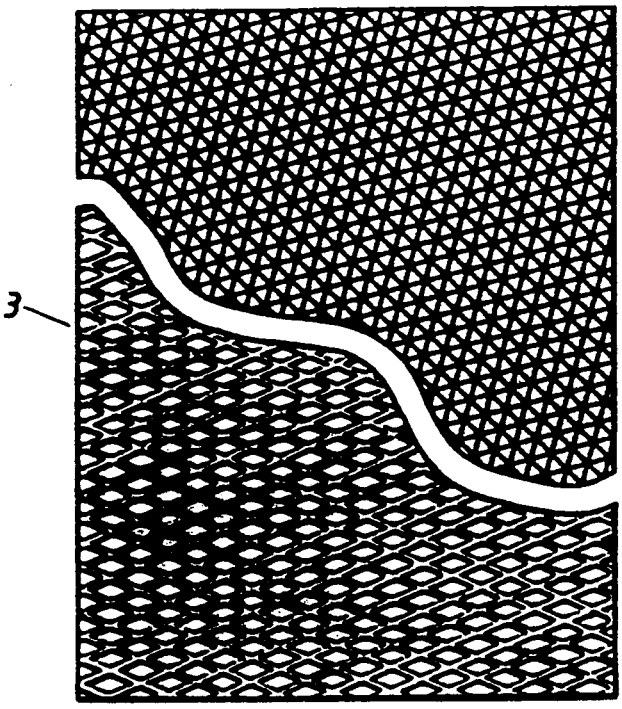
Figure 6B:
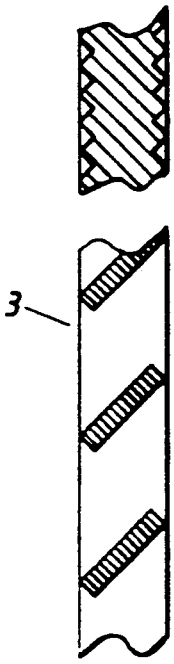

FIGS. 6*a* and 6*b* are a top plan view and a side view, respectively, of another type of intermediate conducting element 3 of expanded metal.

FIG. 7 schematically shows an alternative arrangement where the cells 1 in one row are connected in parallel by every other conducting means 3*a* being connected to the positive terminal of the external current source, while every other conducting means 3*b* is connected to the negative terminal of the external current source. Each conducting means 3*a*, 3*b*, except for the first and the last in each row which are disposed at the end walls of the frame, is disposed between two anodic or two cathodic cell end walls. The individual cells thus are alternately arranged in different directions, but may otherwise be of the same design as described above in connection with the other embodiments.

In the production of sodium chlorate with an electrolyser according to the embodiment described, the cells 1 are supplied with an aqueous solution containing sodium chloride through the lower riser pipe 14. The solution flows upwards through the cells 1 between the anode plates 8 and the cathode plates 10, across which an electric voltage exists, and out through the upper riser pipe 13. In the cells, mainly hypochlorite and hydrogen gas are formed. The gas is separated and withdrawn, while the solution is supplied to one or more reactors (not shown) where the hypochlorite is converted into chlorate. A portion of the chlorate is withdrawn as a product, a solution or crystals, while the remainder is recycled and returned to the cells 1 together with freshly-supplied sodium chloride through the lower riser pipe 14.

We claim:

1. An electrolytic cell comprising an anodic end wall and a cathodic end wall facing each other and supporting alternately arranged plate-shaped anodes and cathodes extending substantially perpendicularly to said end walls, at least some of said anodes and/or cathodes cooperating with the opposite end wall via electrically insulating spacer members enabling compressive forces to be transmitted between said end walls.

2. An electrolytic cell as claimed in claim 1, wherein the cell comprises a casing in which the anodes and cathodes are arranged, the casing being closed except for an inlet and an outlet for electrolyte.

3. An electrolytic cell as claimed in claim 1, wherein at least the outer surface of each of the cell end walls comprises a substantially plane portion substantially perpendicular to the electrode plates.

4. An electrolytic cell as claimed in claim 1, wherein the anodes cooperate with the opposite cathodic cell end wall.

5. An electrolytic cell as claimed in claim 1, wherein one or both of the two end walls of the cell are provided on the outer surfaces with a layer having high electric conductivity.

6. An electrolyzer comprising at least one row of series-or parallel-connected electrolytic cells as claimed in claim 1, the cells being electrically connected to each other via their end walls.

7. An electrolyzer as claimed in claim 6, wherein the cells are arranged so as to be subjected to compressive forces substantially perpendicularly to the cell end walls.

8. An electrolyzer as claimed in claim 6, wherein the electrolyzer is provided with conducting means between the cells.

9. An electrolytic cell comprising an anodic end wall and a cathodic end wall facing each other and supporting alternately arranged plate-shaped anodes and cathodes extending substantially perpendicularly to said end walls, at least some of said anodes and/or cathodes cooperating with the opposite end wall via electrically insulating spacer members enabling compressive forces to be transmitted between said end walls, and wherein the cell is made of up an anodic part in the form of a trough detachably joined with a cathodic end wall, electrically insulating means being placed between the anodic trough and the cathodic end wall.

10. An electrolytic cell comprising an anodic end wall and a cathodic end wall facing each other and supporting alternately arranged plate-shaped anodes and cathodes extending substantially perpendicularly to said end walls, at least some of said anodes and/or cathodes cooperating with the opposite end wall via electrically insulating spacer members enabling compressive forces to be transmitted between said end walls, and wherein the outer surface of at least ne end wall includes a valve metal, and is provided with a layer wettable by soft-solder and joined to the surface of the end wall in a manner sufficient for supporting a soldered joint.

11. An electrolyzer comprising at least one row of series or parallel-connected electrolytic cells, each of the cells comprising an anodic end wall and a cathodic end wall facing each other and supporting alternately arranged plate-shaped anodes and cathodes extending substantially perpendicularly to said end walls, at least some of said anodes and/or cathodes cooperating with the opposite end wall via electrically insulating spacer members enabling compressive forces to be transmitted between said end walls, and wherein the cells are electrically connected to each other via soft solder applied to their end walls.

12. An electrolyzer comprising at least one row of series or parallel-connected electrolytic cells, each of the cells comprising an anodic end wall and a cathodic end wall facing each other and supporting alternately arranged plate-shaped anodes and cathodes extending substantially perpendicularly to said end walls, at least some of said anodes and/or cathodes cooperating with the opposite end wall via electrically insulating spacer members enabling compressive forces to be transmitted between said end walls, wherein the walls are electrically connected to each other via intermediate conducting elements connecting the end walls of the cells, the conducting elements being held at their positions by compressive forces created by pressing the cells in a row together.

13. A method of performing electrolysis comprising the steps of feeding an electrolytic solution to an electrolytic cell, applying an electric voltage thereto and recovering electrolytic products from the cell, wherein the electrolytic cell comprises an anode end wall and a cathodic end wall facing each other and supporting alternately arranged plate-shaped anodes and cathodes extending substantially perpendicularly to said end walls, at least some of said anodes and/or cathodes cooperating with the opposite end wall via electrically insulating spacer members enabling compressive forces to be transmitted between said end walls.

14. A method as claimed in claim 13, wherein said electrolytic solution comprises an aqueous sodium chloride solution and wherein the electrolytic products comprise sodium hypochlorite and hydrogen gas.

* * * * *